US008336744B2

(12) United States Patent
Griffin

(10) Patent No.: US 8,336,744 B2
(45) Date of Patent: Dec. 25, 2012

(54) FLOW LIMITING BOTTLE CAP

(76) Inventor: David L. Griffin, O'Fallon, MO (US)

( * ) Notice: Subject to any disclaimer, the term of this patent is extended or adjusted under 35 U.S.C. 154(b) by 0 days.

(21) Appl. No.: 13/109,220

(22) Filed: May 17, 2011

(65) Prior Publication Data

US 2011/0215066 A1 Sep. 8, 2011

Related U.S. Application Data

(63) Continuation-in-part of application No. 12/154,925, filed on May 28, 2008, now abandoned, which is a continuation-in-part of application No. 09/288,739, filed on Apr. 7, 1999, now abandoned, which is a continuation-in-part of application No. 09/284,345, filed on Apr. 14, 1999, now Pat. No. 6,129,295.

(51) Int. Cl.
*B67D 3/00* (2006.01)

(52) U.S. Cl. ..... 222/525; 222/523; 222/575; 239/548; 239/596; 239/601

(58) Field of Classification Search ..... 222/523, 222/525, 553, 565, 575; 239/542, 548, 601, 239/596, 592

See application file for complete search history.

(56) References Cited

U.S. PATENT DOCUMENTS 3,834,596 A * 9/1974 Brady et al. ..... 222/520
5,810,185 A * 9/1998 Groesbeck ..... 215/387
7,316,067 B2 * 1/2008 Blakey ..... 29/896.6

* cited by examiner

*Primary Examiner* — Jason Boeckmann
(74) *Attorney, Agent, or Firm* — Charles McCloskey

(57) ABSTRACT

The flow limiting bottle cap secures to a container having a threaded neck and allows a user to select an open or a closed position without removing the cap from a container. Additionally fluid from within a container, when poured, forms multiple separate streams in laminar flow. The cap provides a pattern of conically shaped holes for passing of fluid. Each hole has edge conditions for adjusting the flow relative to pouring. The cap opens by raising an upper portion and closes by lowering the upper portion or by rotating the upper portion to expose the holes and closing by rotating oppositely to block the holes. Knurling upon the perimeter of the upper portion aids the user. An internal seal also excludes atmospheric communication to reduce spoilage of fluids within a container.

5 Claims, 3 Drawing Sheets

FLOW LIMITING BOTTLE CAP

CROSS REFERENCE TO RELATED APPLICATIONS

This non-provisional application is filed as a continuation in part of the non-provisional application Ser. No. 12/154,925 with a filing date of May 28, 2008 now abandoned which was filed as a response to a petition to revive application Ser. No. 09/288,739 and claims priority to the continuation in part application Ser. No. 09/288,739 filed Apr. 7, 1999 now abandoned under petition for revival, which claims priority to the continuation in part application Ser. No. 09/284,345 filed Apr. 14, 1999, now U.S. Pat. No. 6,129,295, and the continuation in part application Ser. No. 09/537,163 filed Mar. 27, 2000 which has been merged into the continuation in part application Ser. No. 09/288,739 which claims priority to the non-provisional application Ser. No. 09/034,757 filed Mar. 4, 1998, now abandoned and this non-provisional application claims priority to the non-provisional application Ser. No. 11/402,673 filed Apr. 13, 2006, now abandoned.

BACKGROUND OF THE INVENTION

The flow limiting bottle cap relates to closures of beverage containers and more specifically to a cap having a pattern of holes therein reducing turbulent flow of a liquid poured through the cap and dripping from the cap upon ending a pour.

From earliest days, people have needed to quench thirst. After drinking and collecting water from surface locations, people developed containers of various kinds. The containers generally had one opening for filling and drinking of fluids within the container.

One such container includes the one gallon milk jug commonly used in homes nationwide. This jug has a rectangular base with rounded corners and then a somewhat rounded three sided pyramidal top portion. Opposite the top portion, a handle allows a person to grip the container. The handle and top portion join at a shoulder denoting the uppermost and narrowest portion of the container. The shoulder has a generally smooth, partially spherical form with the remainder of the container locating beneath it. The shoulder has a neck with an opening therethrough and threading upon the exterior of the neck for receiving a cap.

The inventor has experienced and witnessed over the years, that when pouring a liquid from the typical milk jug, the milk has gushed outwardly in a wide, single stream. Quick holders of a milk jug detect the onset of a milk gusher and correct the angle of pour in time. However, others suffer a preventable spill of milk.

DESCRIPTION OF THE PRIOR ART

Other containers, such as water bottles, often have a push pull type cap. This cap provides an aperture, sometimes a ring shape, that causes a single stream of fluid to exit a container. A user may compress the container to accelerate the stream. However, these push pull caps permit a gush of fluid to exit the container with the risk of spillage for the unwary.

Other devices have sought to regulate the flow of fluid through a cap upon a container, generally for beverages. The Japanese patent to Omi, No. 10-167309, describes a push/pull type cap with an over cap extending from a composite cap that mounts to the mouth of a container. Omi describes a ceiling wall that retains fluid within the container. The ceiling wall has polygonal scoring, here octagonal. A breaking protrusion from the over cap breaks the scoring, into triangular shaped pieces that deflect like a hinge. The triangular shaped pieces provide additional edges that must be sealed to prevent leaks. The breaking protrusion enters the composite cap when the cap is closed and when the cap opens in the second position, fluid is removed from the cap. The remaining piece 10c serves as a hinged flap in regulating the flow of fluid through the cap. The remaining pieces attain a flat orientation with the breaking protrusion removed.

On the other hand, the present invention has a membrane with a central orifice that admits fluids therethrough. The orifice remains open in the absence of the truncated cone. The round orifice has the minimum perimeter for a given surface area thus minimizing the risk of leaks. The orifice becomes closed as the truncated cone fits into it. The orifice retains its round shape as the truncated cone stretches the membrane slightly. The membrane generally retains its planar orientation and does not have hinged parts or subparts that move under the action of the truncated cone.

The present invention overcomes the difficulties of the prior art as described above. That is, the prior art has a push pull cap with a central orifice. The prior art orifice has a hexagonal outer perimeter and triangular shaped pieces as hinged flaps. The central orifice allows for continuous flow from a round opening. The present invention though reduces the onset of a sudden gush of fluid poured from a container regardless of the angle of the container. This invention operates upon milk, juice, water based beverages, and alcoholic beverages. Though containers for beverages are described, containers of other fluids where a gush of fluid causes difficulties are also foreseen.

SUMMARY OF THE INVENTION

Generally, the present invention is a two-piece bottle cap designed to fit a milk or other beverage container. The cap includes two portions and easily attaches upon the existing external threads of the container. The cap has a quick sealing feature from a truncated conical member inserted into a circular hole in a semi-flexible membrane. More particularly, the cap has its upper member with a plurality of conically shaped holes therein where the holes produce a laminar produce a laminar flow of fluid outwardly from the beverage container when tipped. The holes also have an edge condition that ceases flow of fluid promptly as the container moves into an upright orientation.

There has thus been outlined, rather broadly, the more important features of the invention in order that the detailed description thereof that follows may be better understood and that the present contribution to the art may be better appreciated. The present invention also includes usage upon watering cans, a pattern of conically shaped holes guiding the flow of fluid through the cap, and a plunger seating in the orifice blocking flow out of the cap during non-usage. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved flow limiting bottle cap.

Another object is to provide such a cap that provides for a constant flow through the cap regardless of the angle of the fluid container to which the cap connects.

Another object is to provide such a cap that provides for laminar flow of fluid through the cap during pouring from the fluid container having the cap.

Another object is to provide such a cap that provides for ceasing of fluid flow through the cap upon righting of a fluid container having the cap as in after pouring.

Another object is to provide such a cap that has a low cost of manufacture with regard to both materials and labor, and which accordingly then has a low sale price to the milk packagers and then to the consuming public.

The above and further objects and novel features of the invention will be more fully apparent from the following detailed description when the same is read in connection with the accompanying drawings.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
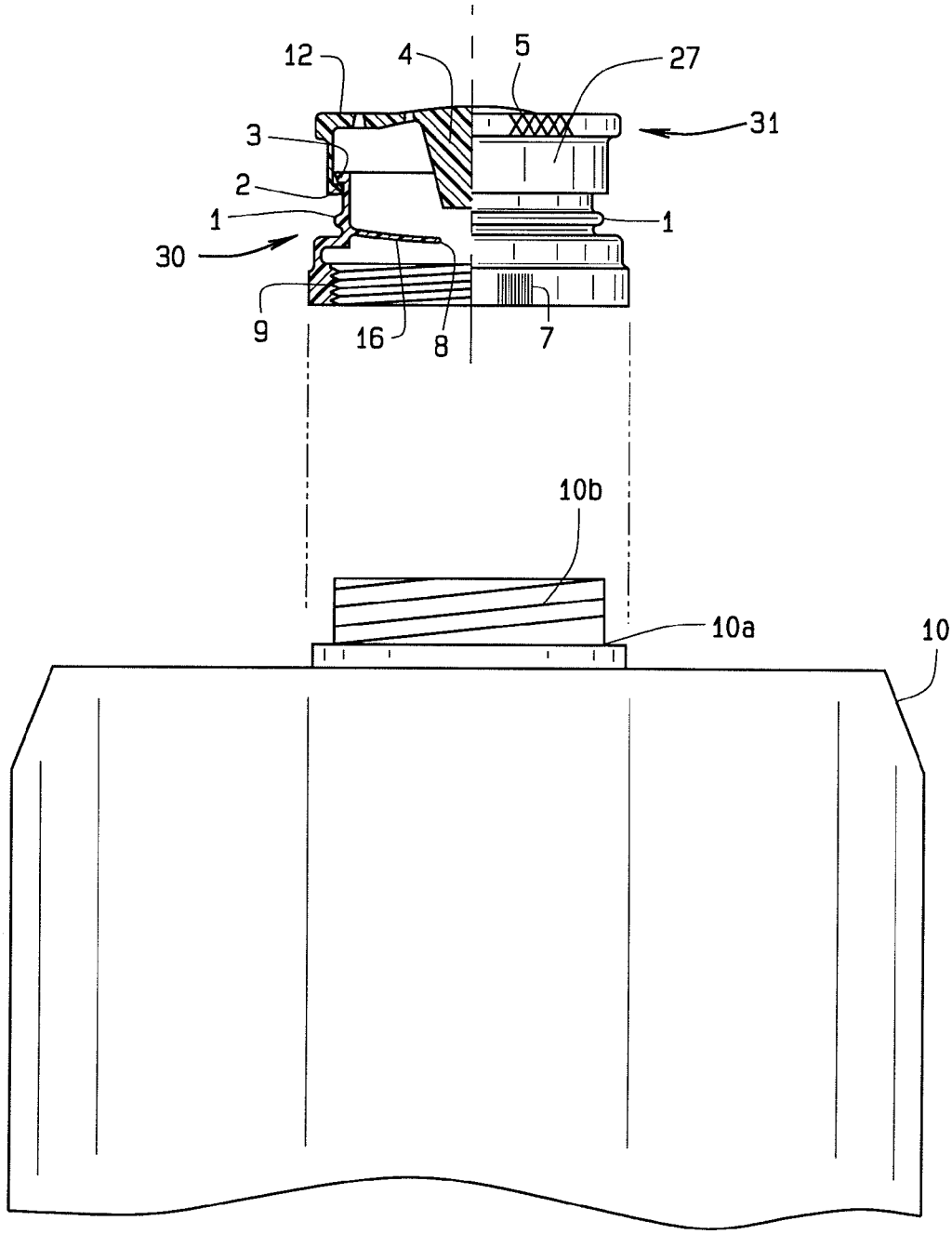
FIG. 1 illustrates the flow limiting bottle cap, in the open position, in a partially exploded view above the neck of a container.

The present invention overcomes the prior art limitations and provides a flow limiting bottle cap for use upon beverage containers, primarily milk jugs. FIG. 1 shows the present invention ready for securement upon a container 10. The present invention connects to a neck 10*a* extending from the uppermost portion of the container. The neck has generally external threads as at 10*b*. The invention generally substitutes with the original closure cap found on either a half or a full gallon jug of milk in a plastic bottle. After purchasing the milk, the supplied cap and security seal, if present, are removed by the customer. The customer may or may not retain the supplied cap for reuse in the absence of the invention. The cap of the invention generally screws upon the external threads, as at 10*b*, upon the beverage container in place of the original cap.

The cap has a lower portion 30 and a concentric upper portion 31. The lower portion engages the neck 10*a* of the container and the upper portion allows for opening the cap and passage of fluid therethrough. The upper portion is generally outwardly from the lower portion. The lower portion is generally cylindrical with a continuous raised first rib 1 molded into the perimeter. The rib extends outwardly and generally has a semi-circular cross section. Above the raised rib, the lower portion has an upper edge 3 upon the perimeter also extending outwardly. As shown in the detail, the upper edge may have a generally trapezoidal cross section. Generally below the first rib 1 and within the lower portion, the cap has a membrane 16. The membrane extends inwardly from the perimeter and has a central round orifice 8. The membrane is generally semi-rigid and continuous around the inside of the lower portion and has a slight angle towards the lower portion. Beneath the membrane, the lower portion has internal threading, as at 9, that cooperates with the external threads 10*b* upon the neck 10*a* of the container. Upon the outer perimeter of the lower portion and generally outside the threads, the lower portion has a pattern of knurling, here shown as vertical lines 7, that aids a user in rotating the cap onto the neck.

The upper portion 31 also has a generally hollow cylindrical shape but with one end closed. Upon the perimeter of the upper portion, the upper portion has a second rib 2 having a semi-circular cross section and generally extending inwardly. The second rib abuts the upper edge 3 when the cap is in an opened position and abuts the first rib 1 when the cap is in a closed position as later described. The second rib extends from the lower edge of a wall 27 generally in cylindrical form. The wall extends away from the upper edge to the plate 12. The plate spans across the width of the upper portion 31. Depending from the center of the plate, the plunger 4 extends beyond the height of the upper portion 31 towards the lower portion. The plunger generally fits snugly within the orifice 8 of the membrane 16 when the cap is in the closed position. The snug fit of the plunger 4 into the orifice 8 prevents fluid from exiting the cap of the invention. The wall 27 generally is perpendicular to the plane of the plate. Upon the outside of the wall proximate the plate, the upper portion 31 has a knurling pattern here shown as 5 in a diamond pattern that aids a person in gripping the upper portion during rotation.

Figure 2:
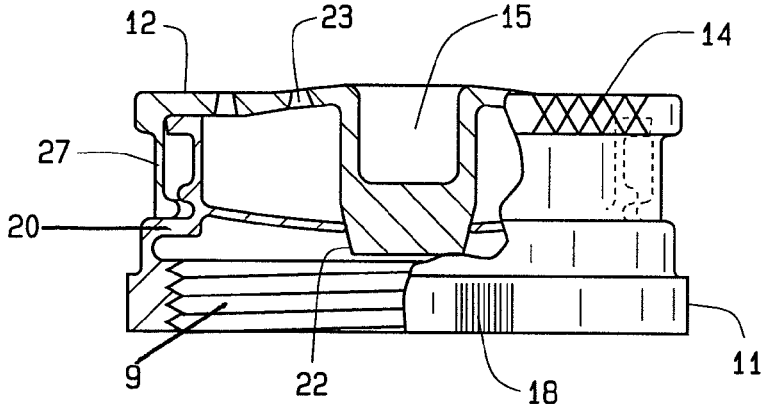
FIG. 2 is an enlarged, partially sectional view of the cap showing the plunger occupying the orifice in the closed position.

The cap occupies the closed position shown in FIG. 2 where the cap seals upon the container in several ways. The internal protruding member, or plunger 4, has a truncated conical surface or tip 22, opposite the plate 12, which closes the membrane 16 which contains an interference fit hole in it when the upper portion 31 of the cap is closed upon the lower portion 30 whether the locking thread segments 17—the first rib 1 and the second rib 2—are engaged or disengaged, then the upper cap member is raised so the conical surface 22 escapes the membrane 16 opening the orifice 8. When the container is tipped, the fluid flows only through the hole pattern 23 in a plate 12 of the upper portion. A partial sealing feature is established by the ring 21, or second rib 2, and a smooth radius 24 of the upper edge 3 that blends with the smooth surface 13 of the wall 27 of the upper portion of the cap of this invention. This ring 21 has a light sliding fit against the cylindrical vertical surface of the wall in the lower portion. The plunger 4 may take various forms subject to manufacturing constraints, including weight savings provided by a cylindrical void 15 in the center of the plunger. This void illustrates an option for material savings or weight savings.

Figure 3:
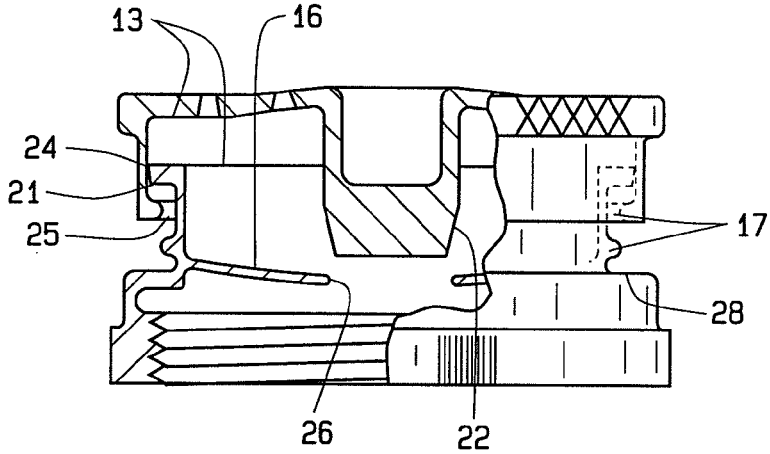
FIG. 3 is an enlarged, partially sectional view of the cap showing the plunger away from the orifice in the open position.

Another sealing feature takes place when the cap opens as in FIG. 3. This sealing feature locks the cap into position and prevents inadvertent rotation. This sealing feature has three segments 17 of a screw type thread similar to that used on the base and socket of incandescent light bulbs. The upper portion 31 has elements of this thread type as seen and used on commercial light bulbs, generally an external thread. The lower portion 30 has cooperating elements of this type thread as seen and used on commercial light bulbs, generally an internal thread, as in the socket for a bulb. The design in the cap of the present invention uses only short segments of these threads 17 where each segment occupies approximately forty five degrees of arc about the center of the lower portion, and each segment is also spaced at about one hundred twenty degrees radially in the upper portion and the lower portion. The axial location of the segments 17 on the upper cap member is at a point where the lowest end of the segment is adjacent to the lowest extreme of the second rib as at 25 and the thread segments 17 on the upper portion in such a way that the upper extreme edge, as at 13, of the lower portion 30 contacts the interior surface of the plate 12 and at the same time the lowest extreme of the second rib as at 25 does not contact the intermediate surface 28 of the lower portion. The intermediate surface is generally parallel to the top of the container. As mentioned above, closing and locking the upper portion and the lower portion engages the conical surface 22 of the plunger 4 into the orifice 8 of the membrane member 16.

To begin usage of the invention, referring to FIGS. 1, 2, the cap has internal threads 9 which cooperate with the external threads of a conventional plastic milk bottle of a half or one gallon capacity. The internal threading extends into the lower portion until it reaches an extension 20. The extension 20 has a generally round cylindrical like shape though a lesser thickness radially than the lower portion proximate the internal threading 9. The extension generally supports the intermediate surface 28 and then the membrane 16. The cap installs on the neck 10*a* of the bottle by turning the lower portion 30 upon the threads 10*b*, similar to a nut on a bolt. The knurling, as at 7, 18, enhanced the turning of the cap by aiding the fingers of a user to grip the raised diameter 11 at the bottom of the lower portion 30 of the cap. The cap may be installed on the container in either the closed or the open position.

Then during usage of the container having the invention installed, the user can turn the cap, particularly the upper portion 31 as need. If the upper portion of the invention is in the open, or pouring configuration, as in FIG. 3, pushing it down and rotating it a quarter turn clockwise, when looking at the upper portion, will seal it in the closed position as shown in FIG. 2. If the user wants to pour fluid from the container, reversing the previous steps opens the cap. The fluid flow is then controlled by a typical hole pattern 23 in the plate 12 when the container is tipped by the user.

Figure 4:
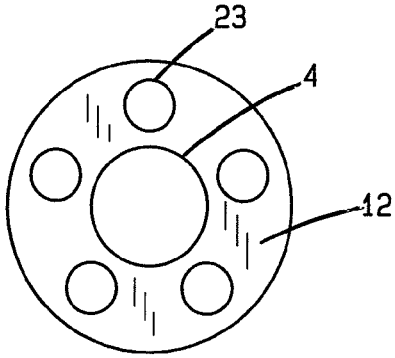
FIG. 4 is a top view of the cap showing a pattern of holes.

FIG. 4 shows a hole pattern in the upper cap member. This figure shows five holes though the number may vary to suit an application. The preferred arrangement of the hole pattern meets the flow characteristics of the fluid and whether it is to be poured narrowly in a single stream, in a plurality of streams, or a wide stream. In these pour conditions, the total area of the holes in the pattern 23 in the plate 12 cap shall not exceed seventy five percent, preferably sixty five to seventy percent, of the area of the orifice 26 in the membrane member. This ratio establishes the liquid having a head value to assure proper flow through the holes without an abrupt gush of fluid. This ratio can be calculated from the following formula:

$$d_i \approx d_o \sqrt{\frac{a}{N}}$$

where $d_i$ is the hole 23 diameter, $d_o$ is the orifice 26 diameter, a is the desired area ratio of $d_i$ to $d_o$ and N is the number of holes.

Figure 5:
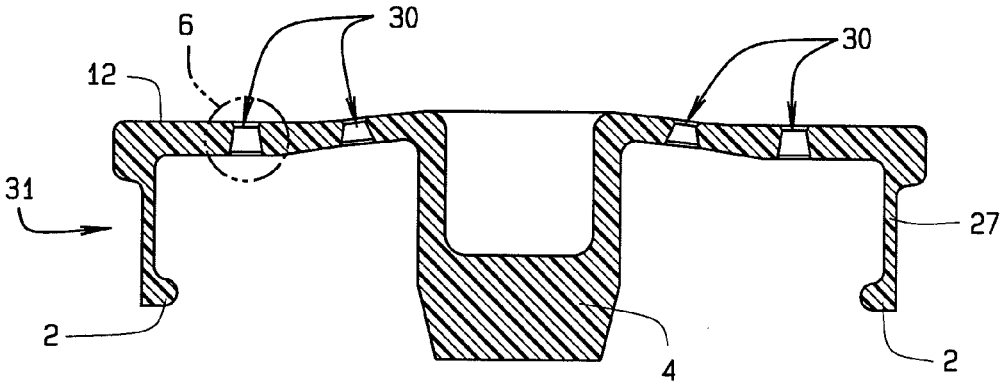
FIG. 5 is a partially sectional view of an alternate embodiment of the cap.

Turning to an alternate embodiment, FIG. 5 shows a sectional view through the upper portion 31 of the cap. The upper portion is generally cylindrical in shape with one end closed. The upper portion has a wall 27 generally round forming the cylindrical shape. As shown, the wall has a rib 2 upon the lower edge of the wall. Opposite the rib, the upper portion has a plate 12, generally planar but round in shape that spans across the wall closing the cylindrical shape. Inwardly from the wall, the plate has a pattern of openings 30. These openings have a generally conic shape with a narrow exit and an opposite wider entrance as later shown in FIG. 6. The openings allow for passage of fluid passage of fluid there through subject to precise control from a user of the container. Generally centered upon the plate and depending within the wall, the upper portion has the plunger 4 that fits into the orifice 8 as described above. This alternate embodiment of the upper portion fits upon the lower portion as previously described.

Figure 6:
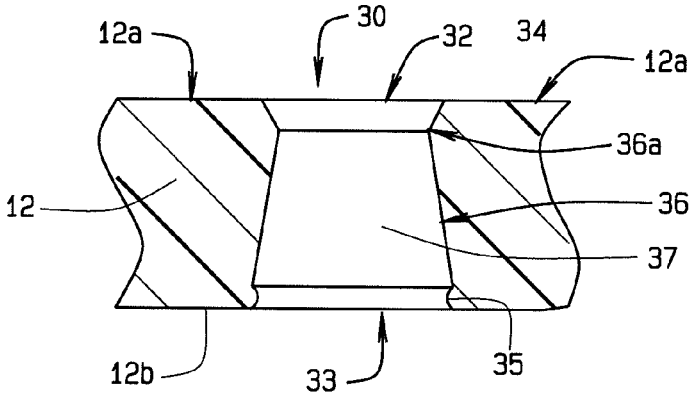
FIG. 6 is a detailed sectional view of an opening in the cap.

Viewing the plate 12 more closely, FIG. 6 shows a detailed sectional view of an opening 30. Though this figure shows one opening, the description applies to all of the openings 30 shown in FIG. 5 or in foreseeable patterns of openings. Each opening provides a hollow passage 37 through the plate 12 from a lower surface 12*b*, generally towards the wall 27, to the upper surface 12*a*, generally outwardly from the wall and opposite the lower portion when installed. The opening has a wide, round entrance 33 that admits fluid into the passage. The passage then tapers through a throat 36, or generally truncated continuous conical shape extending from the lower surface to the upper surface as shown in this figure. The throat then narrows to a narrow, round exit 32 in the upper surface 12*a* of lesser diameter than the entrance. More particularly, the entrance 33 in the lower surface 12*b* has a rounded edge condition upon its circumference, as at 35. The rounded edge condition extends slightly radially inwardly, forming a lip as shown as at 35, and provides a smooth transition of fluid from the turbulence of the container into the passage 37 and then the throat 36. Opposite the entrance, the opening has its exit 32 with an edge condition for terminating flow precisely without dripping. The exit has a sharp crested edge condition as at 34 upon its circumference. As shown, the sharp crested edge defines the narrowest diameter associated with the edge at its joint with the throat 36*a*. The sharp crested edge then slightly widens its diameter to attain that of the exit 32 as viewed from the upper surface 12*a* of the plate 12. The sharp crested edge attains a generally bevel like edge around the circumference of the exit so that fluid flows in a laminar manner regardless of how a user orients the cap and the container. When a user finishes pouring a liquid from the container, the user orients the container upright, that is cup up, and in doing so increases the effective angle of the sharp crested edge so that fluid flow terminates precisely and without any drips.

Figure 7:
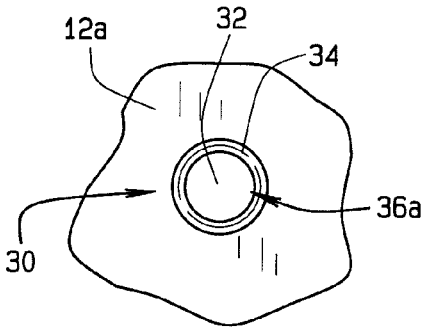
FIG. 7 is a top view of an opening in the cap.
Figure 8:
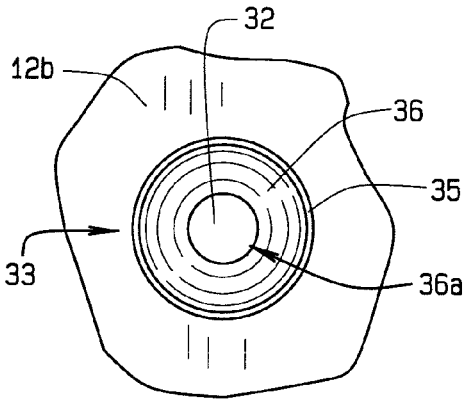
FIG. 8 is a bottom view of the opening in the cap.

When using the cap including the alternate embodiment, a user views the upper surface 12*a* of the plate 12 as shown in FIG. 7. Each opening 30 appears as round with the exit 32 showing the sharp crested edge 34 narrowing in diameter to the joint 36*a* with the throat that opens into the background of this figure. The exit 32 releases fluid from the throat in laminar flow for a crisp pour. Opposite the exit 32 each opening 30 appears in the lower surface 12*b* of the plate as in FIG. 8. A user views this before installing the upper portion upon the lower portion of the cap. Each opening has the round entrance 33 with a rounded edge 35 upon its circumference. The entrance admits fluid into the throat. The throat has a conical shape with its larger diameter proximate the rounded edge that narrows to the smaller diameter proximate the joint 36*a* with the sharp crested edge 34 in the background of this figure.

From the aforementioned description, a flow limiting bottle cap has been described. The cap is uniquely capable of regulating the flow of a poured fluid from a beverage container to avoid an abrupt gush of fluid. Though milk and juice containers have been described, the present invention also may apply to watering cans, pesticide sprayers, other gardening applicators, paint spraying, and the like liquid dispensers. The cap and its various components may be manufactured from many materials, including but not limited to, polymers, high density polyethylene, polypropylene, ferrous and non-ferrous metals, their alloys, and composites. The material used to produce the cap is preferably high quality, semi-flexible, colored plastic. The preferred cap then undergoes injection molding in a steel die for its manufacturing.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device limiting fluid flow from a container having a threaded neck, said device avoiding fluid gushing from said container during pouring and ending fluid flow from said container without dripping after pouring, said device, comprising:

a lower portion having a generally cylindrical shape, a semi-rigid membrane, substantially planar, spanning generally across said lower portion, said membrane having a centered round orifice, a first rib outwardly from said lower portion, internal threading adapted to attach said device to the threaded neck, and an intermediate surface generally outward from said membrane and generally perpendicular to said membrane;

an upper portion having a generally planar cap, a hollow cylindrical wall beneath said cap, a second rib extending outwardly upon said wall and engaging said first rib and connecting said upper portion to said lower portion wherein said upper portion remains with said lower portion during usage, a round plunger centered in said upper portion and depending from said cap and including a truncated conical tip fitting into said orifice upon closing said upper portion upon said lower portion by rotation of said upper portion relative to said lower portion and by pushing said upper portion upon said lower portion, and said upper portion rotating coaxially upon said lower portion;

said cap having an upper surface positioned outwardly and an opposite lower surface positioned inwardly;

a pattern of spaced apart openings through said cap combining to provide less than the area of said orifice, said openings providing passage of fluid through said device without compression of the container;

each of said openings having a generally truncated continuous conical shape, a narrow exit positioned outwardly of said cap and an opposite wider entrance positioned inwardly of said cap, each of said exits having a sharp crested edge condition in said upper surface, each of said entrances having a rounded edge condition in said lower surface, said rounded edge condition forming a lip upon the circumference of said entrance and extending radially inwardly into said opening, the truncated continuous conical shape extending from the rounded edge condition of said entrance to the sharp crested edge condition of said exit; and, said device having a closed position with said upper portion adjacent to said lower portion and an opened position with said upper portion away from said lower portion;

wherein said device is adapted to allow a user to operate said device using one hand.

2. The flow limiting device of claim 1 further comprising:

said pattern of spaced apart openings combining to provide approximately sixty five percent to approximately seventy five percent of the area of said orifice.

3. The flow limiting device of claim 1 further comprising:

said second rib adjoining said first rib when said device is in the opened position.

4. The flow limiting device of claim 3 further comprising:

said lower portion having an upper edge, generally parallel to and outwardly from said first rib; and, said second rib abuts said upper edge when said device attains the opened position.

5. A device limiting fluid flow from a container having a threaded neck, said device avoiding fluid gushing from said container during pouring and ending fluid flow from said container without dripping after pouring, said device, comprising:

a lower portion having a generally cylindrical shape, a semi-rigid membrane, substantially planar, spanning generally across said lower portion, said membrane having a centered round orifice, a first rib outwardly from said lower portion, internal threading adapted to attach said device to the threaded neck, and an intermediate surface generally outward from said membrane and generally perpendicular to said membrane;

an upper portion having a generally planar cap, said cap having an upper surface positioned outwardly and an opposite lower surface positioned inwardly, a hollow cylindrical wall beneath said cap, a second rib extending outwardly upon said wall and engaging said first rib and connecting said upper portion to said lower portion wherein said upper portion remains with said lower portion during usage, a round plunger centered in said upper portion and depending from said cap and including a truncated conical tip fitting into said orifice upon closing said upper portion upon said lower portion by rotation of said upper portion relative to said lower portion and by pushing said upper portion upon said lower portion, and said upper portion rotating coaxially upon said lower portion;

a pattern of spaced apart openings through said cap combining to provide less than the area of said orifice, said openings providing passage of fluid through said device without compression of the container, said pattern of openings providing approximately sixty five percent to approximately seventy five percent of the area of said orifice;

each of said openings having a generally truncated conical shape, a narrow exit positioned outwardly of said cap and an opposite wider entrance positioned inwardly of said cap, each of said exits having a sharp crested edge condition in said upper surface, each of said entrances having a rounded edge condition in said lower surface said rounded edge condition forming a lip upon the circumference of said entrance and extending radially inwardly into said opening, and each of said openings having a throat of a continuous conical shape extending from the rounded edge condition of said entrance to the sharp crested edge condition of said exit; and, said device having a closed position with said upper portion adjacent to said lower portion and an opened position with said upper portion upwardly from said lower portion, said second rib meshing with said external thread during rotation of said upper portion upon said lower portion, said second rib adjoining said first rib when said device is in the opened position;

wherein said device is adapted to allow a user to operate said device using one hand.

* * * * *